US006611204B2

(12) United States Patent
Schmurr

(10) Patent No.: US 6,611,204 B2
(45) Date of Patent: Aug. 26, 2003

(54) HAZARD ALARM, SYSTEM, AND COMMUNICATION THEREFOR

(75) Inventor: Randol M. Schmurr, Downers Grove, IL (US)

(73) Assignee: Maple Chase Company, Downers Grove, IL (US)

( * ) Notice: Subject to any disclaimer, the term of this patent is extended or adjusted under 35 U.S.C. 154(b) by 0 days.

(21) Appl. No.: 09/835,685

(22) Filed: Apr. 16, 2001

(65) Prior Publication Data

US 2002/0171544 A1 Nov. 21, 2002

(51) Int. Cl.[7] ..... G08B 1/08

(52) U.S. Cl. ..... 340/538; 340/506; 340/517; 340/521; 340/3.1; 340/825.36; 340/825.49

(58) Field of Search ..... 340/506, 517, 340/538, 521, 3.1, 825.36, 825.49

(56) References Cited

U.S. PATENT DOCUMENTS

| | | | | |
|---|---|---|---|---|
| 3,978,476 A | | 8/1976 | Tanigawa | 340/514 |
| 4,091,363 A | | 5/1978 | Siegel et al. | 340/513 |
| 4,207,558 A | | 6/1980 | Kunzer | 340/524 |
| 4,223,303 A | | 9/1980 | Albinger, Jr. | 340/531 |
| 4,282,519 A | | 8/1981 | Haglund et al. | 340/628 |
| 4,375,637 A | | 3/1983 | Desjardins | 340/517 |
| 4,468,664 A | | 8/1984 | Galvin et al. | 340/825.69 |
| 4,578,669 A | | 3/1986 | Woods | 340/518 |
| 4,586,040 A | | 4/1986 | Akiba et al. | 340/3.9 |
| 4,600,914 A | | 7/1986 | Walsh | 340/692 |
| 4,613,848 A | | 9/1986 | Watkins | 340/541 |
| 4,618,853 A | | 10/1986 | Yuchi | 340/505 |
| 4,641,322 A | | 2/1987 | Hasegawa | 375/145 |
| 4,651,036 A | | 3/1987 | Tallaron | 326/86 |
| 4,692,750 A | | 9/1987 | Murakami et al. | 340/588 |
| 4,777,473 A | | 10/1988 | Weston et al. | 340/514 |
| 4,796,025 A | | 1/1989 | Farley et al. | 340/3.51 |
| 4,916,432 A | | 4/1990 | Tice et al. | 340/518 |
| 4,977,527 A | | 12/1990 | Shaw et al. | 340/636 |
| 5,686,896 A | | 11/1997 | Bergman | 340/636 |
| 5,705,979 A | | 1/1998 | Fierro et al. | 340/517 |
| 5,786,767 A | | 7/1998 | Severino | 340/628 |
| 5,864,286 A | | 1/1999 | Right et al. | 340/501 |
| 5,917,405 A | * | 6/1999 | Joao | 340/426 |
| 5,933,078 A | | 8/1999 | O'Donnell | 340/506 |
| 5,966,079 A | | 10/1999 | Tanguay | 340/636 |

* cited by examiner

*Primary Examiner*—Daryl Pope
(74) *Attorney, Agent, or Firm*—Robert J. Hampsch, Esq.; Richard L. Sampson, Esq.

(57) ABSTRACT

A hazard alarm and alarm system enables a plurality of hazard alarms of multiple types (e.g. smoke alarms, heat alarms, motion detectors, carbon monoxide alarms, gas alarms, and the like), to communicate with one another without generating conflicting alarm warning indicators. Electronic circuitry is also provided, that may be added to at least one of the hazard alarms, for transmitting and receiving digital information with other hazard alarms connected thereto.

61 Claims, 5 Drawing Sheets

HAZARD ALARM, SYSTEM, AND COMMUNICATION THEREFOR

BACKGROUND OF THE INVENTION (1) Field of the Invention

The present invention relates generally to hazard alarms, and more particularly, to a communication system for interconnecting multiple alarms and/or other hazard alarms into a system (e.g. a smoke and carbon monoxide alarm system).

(2) Background Information

Hazard alarm systems are well known. Typical alarm systems include smoke, carbon monoxide (CO), gas, heat, intrusion (e.g., motion) detection, and the like. Substantially all new construction, whether residential or commercial, includes one or more of these systems. Of particular importance for residential dwellings are smoke and CO alarm systems, which detect two of the principle life-threatening hazards associated with home heating: smoke; and CO emissions; respectively.

Smoke and CO alarms have often been self-contained units (i.e. units that include both hazard detection circuitry and an alarm indicator such as a horn or buzzer) that may be placed wherever necessary for the protection of a dwelling. It is generally desirable for numerous reasons, not the least of which is compliance with the U.S. National Fire Code, to electrically connect such self-contained hazard alarms together into a system such that when any one detector is activated all of the detectors sound an alarm.

Albinger, et al., in U.S. Pat. No. 4,223,303, discloses a connection system for connecting a plurality of alarm devices such that an alarm condition (e.g. the detection of a critical level of smoke in a smoke detector) in any one of the alarm devices causes all other alarm devices to generate an alert. No provision, however, is provided for alarm devices of different types. Therefore, in the event smoke and CO alarms, for example, were connected together in this type of system, the detection of smoke in one device would generally cause all detectors, whether smoke or CO detecting devices, to generate an alert. This condition may result in confusion as to the type of hazard and is therefore generally undesirable.

There therefore exists a need for an improved alarm system, enabling multiple hazard device types (e.g. smoke and CO) to be interconnected in a manner such that each hazard device type may generate an alarm signal capable of triggering alarm indicators in other devices of the same type, without triggering alarm indicators associated with any other device types.

SUMMARY OF THE INVENTION

One aspect of the present invention includes a hazard alarm for use in a hazard alarm system. The hazard alarm includes an interface circuit, a first type sensor coupled to the interface circuit, and an alarm indicator coupled to the sensor. A transmitter is coupled to the interface circuit to generate a first type signal in response to a first type alarm event detected by the first type sensor, the first type signal being receivable by at least one other hazard alarm connected thereto to trigger a first type alarm indicator therein, while not triggering any second type alarm indicator connected thereto. A signal receiver is operatively coupled to the interface circuit to receive first type signals and second type signals, and to selectively actuate and not actuate the first type alarm indicator upon respective receipt thereof.

A variation of this aspect includes a system of the hazard alarms being interconnected to one another.

In another aspect, the present invention includes an alarm system including: a plurality of hazard alarms including a plurality of first type hazard alarms and a plurality of second type hazard alarms. Each one of the plurality of hazard alarms includes at least one interconnect port. The first type hazard alarms include an interface circuit coupled to the interconnect port to respectively transmit and receive information with others of the plurality of hazard alarms interconnected thereto. The interface circuit is configured so that an alarm event in any one of the first type hazard alarms triggers an alarm indicator in at least one other of the first type hazard alarms interconnected thereto, while not triggering an alarm indicator in any of the plurality of second type hazard alarms interconnected thereto. The interface circuit receives and transmits digital information at a bit rate of greater than about 100 bits per second.

In another aspect, the present invention includes an interface circuit for a hazard alarm used in an alarm system. The interface circuit includes an input protection portion including at least one input protection component selected from the group consisting of a metal oxide varistor and a zener diode; a high pass filter portion including a transistor; and a signal amplifier portion including a low pass filter coupled to an other transistor.

In still another aspect, the present invention includes a kit for upgrading a smoke alarm system including a plurality of smoke alarms electrically connected to one another. The kit includes a plurality of carbon monoxide alarms, each of the carbon monoxide alarms including at least one interconnect port, and an interface circuit coupled to the interconnect port to communicate information with other hazard alarms interconnected thereto. The carbon monoxide alarms also include a sensor coupled to the interface circuit to detect an alarm event, an alarm indicator coupled to the sensor, and a transmitter coupled to the interconnect port to generate a first signal type in response to the alarm event. The first signal type is receivable by at least one other carbon monoxide detector to trigger an alarm indicator therein, while not triggering an alarm indicator in any smoke alarms connected thereto. A signal receiver is operatively coupled to the interconnect port to receive signals of the first and a second signal types, and to selectively actuate and not actuate the alarm indicator upon receipt of signals of the first and second types, respectively.

In a further aspect, this invention includes a method of fabricating a hazard alarm for use in a hazard alarm system. The method includes providing an interface circuit, and coupling a first type sensor to the interface circuit. The method also includes coupling a first type alarm indicator to the first type sensor, and coupling a transmitter to the interface circuit to generate a first type signal in response to a first type alarm event detected by the first type sensor, the first type signal being receivable by at least one other hazard alarm connected thereto, to trigger a first type alarm indicator therein, while not triggering any second type alarm indicator connected thereto. A signal receiver is operatively coupled to the interface circuit to receive first type signals and second type signals, and to selectively actuate and not actuate the first type alarm indicator upon respective receipt thereof.

In yet a further aspect, this invention includes a method for upgrading an existing smoke alarm system, having a plurality of smoke alarms electrically connected to one another. The method includes providing a plurality of carbon monoxide alarms, each of the carbon monoxide alarms including an interface circuit coupled to an interconnect port to transmit and receive information with other hazard alarms interconnected thereto. The method further includes configuring the carbon monoxide alarms to trigger an alarm indicator in at least one other of the plurality of carbon monoxide alarms in response to an alarm event, while not triggering an alarm indicator in any of the plurality of smoke alarms; and electrically coupling the plurality of carbon monoxide alarms to the smoke alarm system.

DETAILED DESCRIPTION

Referring to the Figures, generally described, the present invention includes an alarm system 100, 100', 200, 200', 200", and a hazard alarm 111, 113, 211, 215, 217, used therein. The system includes a plurality of devices of multiple type hazard alarms (e.g. smoke alarms, heat alarms, motion detectors, carbon monoxide alarms, natural gas alarms, propane gas alarms, and the like), each including at least one interconnect port for connecting the devices to a common interconnect line 116. This invention further includes circuitry 118 added to at least one of the above-mentioned devices, for communicating (i.e. transmitting and receiving) digital information on the interconnect line 116. Embodiments of this invention may provide significant advantages over other heretofore available alarm systems. For example, such embodiments enable carbon monoxide (CO) alarms, and/or other type hazard alarms to be connected with existing smoke alarm systems in an arrangement in which an alarm event detected and/or present on any one of the devices of one type (e.g. smoke alarms) triggers an alarm indicator (e.g. an audible or visible signaling device such as a horn, a buzzer, a bell and/or a bright light) associated only with that type, while not triggering an alarm indicator associated with devices of another type (e.g. CO alarms). The alarm indicators for one type hazard alarm (e.g., a CO alarm) are generally distinct (e.g., generating distinct audible or visual patterns) from those of another type hazard alarm (e.g., smoke alarm), so that a user may implement a response protocol appropriate to the specific hazard. For example, an appropriate response protocol for a CO alarm indicator may include opening windows and alerting the local fire department, while an appropriate response to a smoke alarm indicator may include evacuating the premises and alerting the local fire department.

The skilled artisan will recognize that more than one such discrete alarm indicator may be generated by a single device (e.g., horn, light), without departing from the spirit and scope of the present invention. This invention may be further advantageous in that it provides for digital communication over a common interconnect line. Still further, this invention may provide for simplified installation with reduced costs owing to multiple type hazard alarms sharing a common interconnect line.

Although the embodiments shown and described herein use a physical wired connection between interconnect ports of individual alarm devices, the skilled artisan will recognize that the interconnect ports may include wireless transmitter/receivers or transceivers, and the interconnect line may include any suitable transmission media such as free space or the Earth's atmosphere, to effect communication by RF, infrared, laser, or other suitable wireless communication means, without departing from the spirit and scope of the present invention.

Figure 1A:
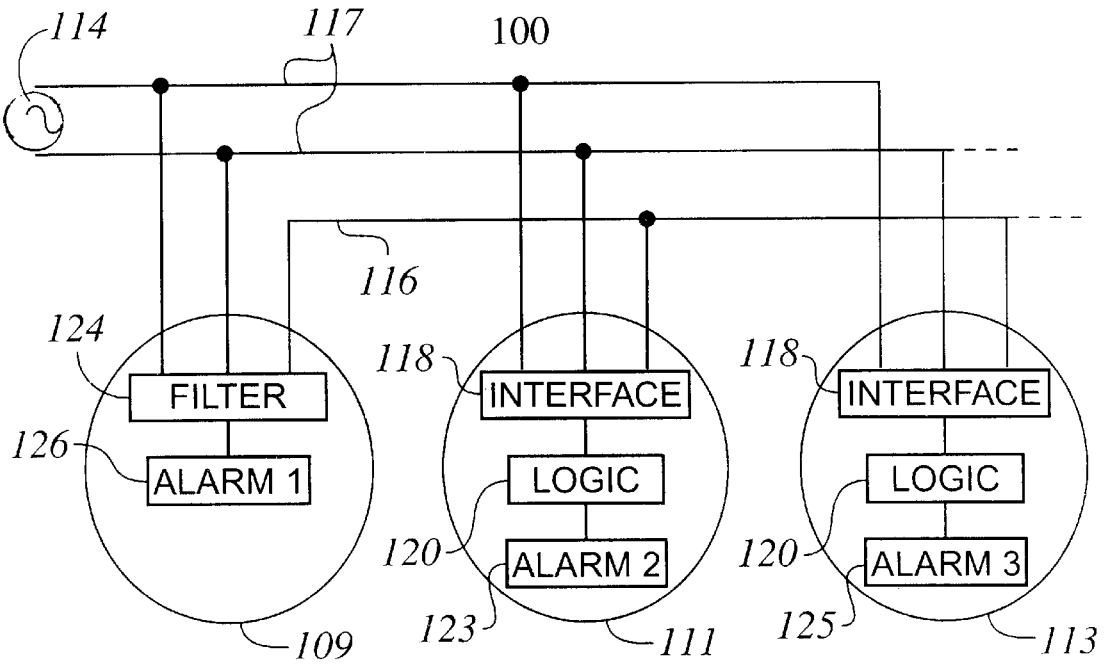
FIG. 1A is a schematic illustration of the alarm system of the present invention using a three wire interconnect system wherein two of the wires are used to provide AC power and the other is an interface wire for electronic communication.
Figure 1B:
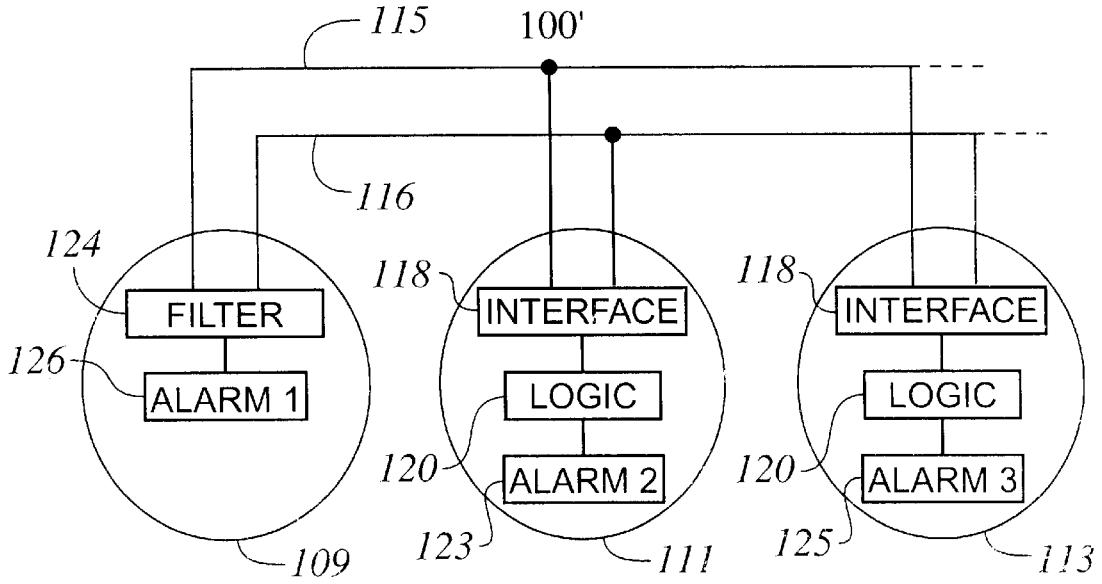
FIG. 1B is a view similar to that of FIG. 1A, of an embodiment using a two wire interconnect system wherein one wire is used to provide a voltage reference and the other is an interface wire for electronic communication.

Referring now to FIGS. 1A and 1B, particular embodiments of the present invention will be discussed in greater detail. System 100 (shown in FIG. 1A) includes a plurality of devices 109, 111, 113, electrically connected by an interconnect line 116 that enables the devices to communicate digitally with one another. System 100 includes three interconnect lines, two of which 117 are employed for providing electric power 114, the other of which is an interconnect line 116. External voltage source 114 is typically an alternating current (AC) source at a nominal 115 VAC and 60 Hz frequency. Other combinations of voltage and line frequency may also be employed.

Device 109 is representative of any type of device having a simple filter circuit 124 which is connectable through a conventional interconnect port or terminal(s) (not shown) to interconnect line 116. Device 109 may include conventional smoke alarms, heat alarms, relay modules, alarm signaling panels, and the like. The device includes a sensing circuit portion 126 capable of detecting the particular hazard and triggering an alarm indicator (not shown).

Devices 111, 113 are representative of any device of the present invention having an interface circuit 118 connectable through a conventional port or terminal(s) (not shown) to interconnect line 116 to communicate digital information. Devices 111, 113 may include carbon monoxide (i.e., CO) alarms, motion detectors, smoke alarms, heat alarms, gas alarms, relay modules, alarm signaling panels, door/window open sensors, building security devices in general, and the like. These devices include a sensing circuit portion 123, 125, respectively, which is capable of detecting the particular hazard, and triggering a local alarm indicator (not shown). As used herein, the term 'local' refers to a component disposed integrally within a particular device, as opposed to components disposed within another device.

Devices 111, 113 may further be of a single type or may be of two or more mutually distinct types of devices. For example, device 111 may be a CO alarm, while device 113 may be heat alarm. Devices 111, 113 may still further include a logic module 120 for modulating the digital information. Logic module 120 may include any suitable component commonly used for this purpose, including an electronic circuit, a microcontroller, an electronic processor, a programmable logic device, a communications processor, a computer, or combination thereof. The structure and function of interface circuit 118 and logic module 120 are discussed in substantially more detail hereinbelow.

Referring now to FIG. 1B, an alternate embodiment of the present invention is shown. System 100' is substantially similar to that of system 100, excepting that the plurality of devices 109, 111, 113 in system 100' do not rely on an external electric power source. Rather, devices 109, 111 and 113 function on battery (or some other local source of) electric power. System 100' includes two connecting lines, a first being interconnect line 116 and a second being a voltage reference 115 (e.g. a ground or neutral wire). Interface circuit 118 may be configured to function independently of any DC voltage that may be present on interconnect line 116, (e.g., due to analog communication between devices 109, 111, 113) and may thus be compatible with either system 100 or system 100', as will be discussed in greater detail hereinbelow.

Systems 100 and 100' generally include a plurality of devices, having at least two types of hazard alarms. Although systems 100 and 100' are shown having three or more devices, the skilled artisan will recognize that this depiction is merely exemplary, to demonstrate the versatility of the present invention. It will be understood that a single device, such as discussed in greater detail hereinbelow, and/or a system including as few as two devices, is within the scope of this invention.

Figure 2A:
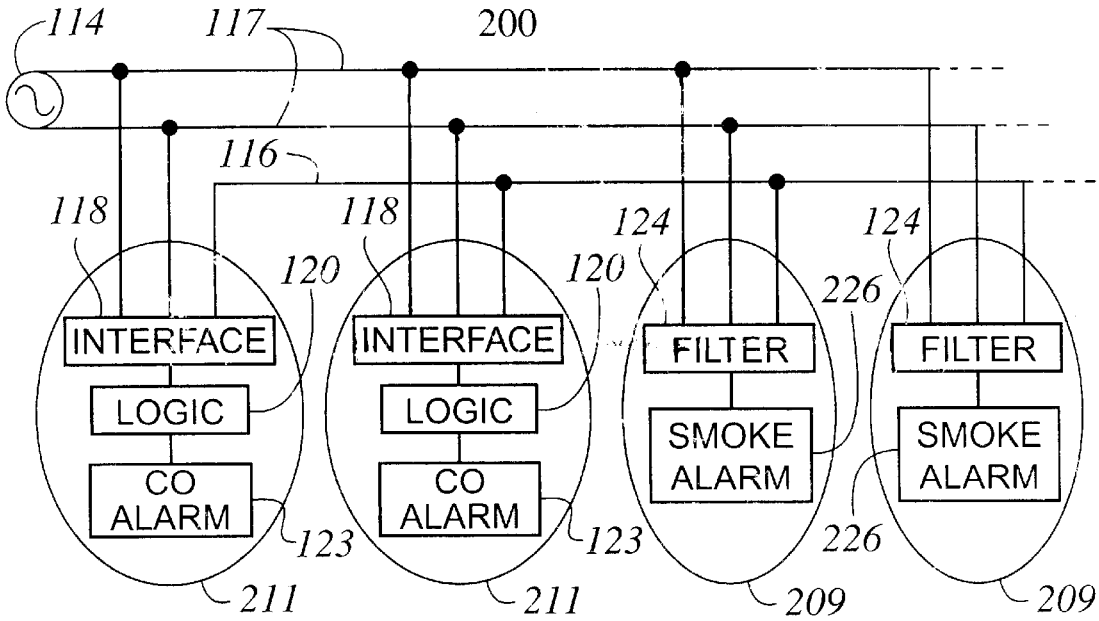
FIG. 2A is a view similar to that of FIG. 1A of an embodiment using a three wire combination smoke and carbon monoxide alarm system wherein two of the wires are used to provide AC power and the other is an interface wire for electronic communication.

Turning now to FIG. 2A, a combination smoke and carbon monoxide alarm system 200 of the present invention includes at least one smoke alarm 209 having a low pass filter circuit 124, and at least one CO alarm 211 having an interface circuit 118 and a logic module 120. System 200 is in many respects substantially similar to system 100. As stated above, although FIG. 2A shows a system including two smoke alarms and two CO alarms, it is understood that system 200 may include any number of smoke alarms 209 and CO alarms 211. System 200 is advantageous in that it enables CO alarms 211 and smoke alarms 209 to share a common interconnect line 116 so that an alarm event detected in one (or more) of the smoke alarm(s) 209 may trigger other smoke alarm indicators (e.g., such as in other interconnected smoke alarms 209), but does not trigger any CO alarm indicators (e.g., does not trigger an alarm indicator in any of the CO alarm(s) 211). Likewise, an alarm event detected by one (or more) of the CO alarm(s) 211 may trigger other CO alarm indicators without triggering smoke alarm indicators (e.g., without triggering alarm indicators in any of the smoke alarm(s) 209 connected thereto).

Embodiments of the present invention provide this desired functionality by sending digital signals along interconnect line 116. For example, in the combination smoke and CO alarm system 200, CO alarm 211 emits a series of digital signals to activate alarm indicators on other interconnected CO alarms 211. Typical smoke alarms use a low pass filter 124 on interconnect line 116, in which a constant direct current (DC) voltage is generally required to activate an alarm indicator on interconnected smoke alarms. The digital signals generally do not activate the smoke alarms, and the DC potential applied by the smoke alarms generally does not activate the CO alarms. Therefore, both CO alarms 211 and smoke alarms 209 (and/or other combinations of devices) may use the same interconnect line without generating false or undesired actuation of devices of other types.

The present invention is further advantageous in that it provides for updating existing (already installed) smoke alarm systems (or other alarm systems in which the individual alarms have a low pass filter interface to an interconnect line) to include devices of other types 111, 113 without making any modifications to the existing alarms. As a result, in a further embodiment of the present invention, a kit may be provided that includes at least one alarm 111, 113 having an interface circuit 118. The kit may further include multiple alarms 111, 113 of a plurality of types. One exemplary kit includes at least one carbon monoxide alarm 211 having an interface circuit 118 configured so that an alarm event in one (or more) of the existing smoke alarm(s) 209 does not trigger an alarm indicator in any of the CO alarm(s) 211. Likewise, an alarm event in one (or more) of the CO alarm(s) 211 does not trigger an alarm indicator in any of the smoke alarm(s) 209.

Figure 2B:
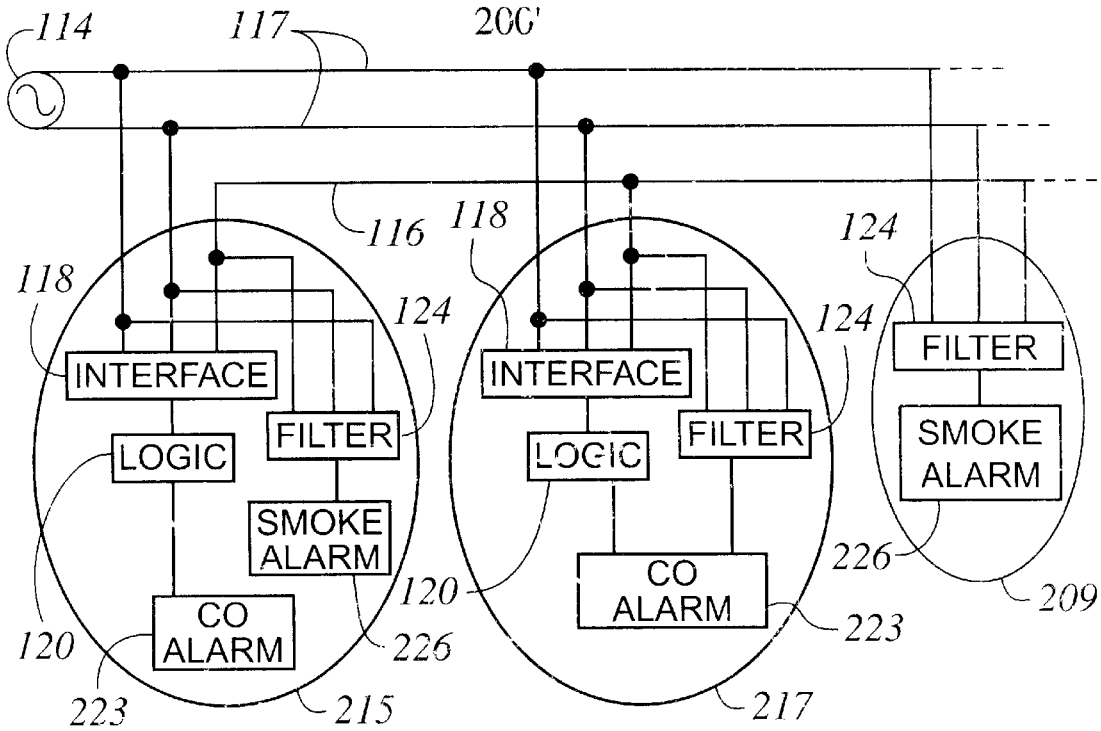
FIGS. 2B and 2C are views similar to that of FIG. 2A, of further embodiments of the present invention.

Referring now to FIG. 2B, in alternate embodiments of the present invention, interface circuit 118 and filter circuit 124 may be combined into a single unit, such as a combination CO/Smoke alarm 215 and/or a modified CO alarm 217. As shown, each of these embodiments may include a filter 124 to detect whether a smoke alarm condition is being communicated over interconnect line 116. In the event such a smoke alarm condition is detected, the alarms 215 and/or 217 may trigger a local alarm indicator for a smoke event (if alarms 215, 217 are equipped to do so). Alternatively, in the event alarms 215 or 217 are configured with only a CO alarm indicator, they may remain silent (or provide no visual indicator) upon receipt of a smoke alarm condition communication in order to give the smoke alarm condition precedence over a CO alarm condition. These alarms 215 and 217 may both operate in the manner described hereinabove to detect presence of CO and transmit a CO alarm condition signal over line 116 to other interconnected alarm devices.

In addition to the interface 118 and filter 124, combined CO/Smoke alarm 215 includes a smoke sensing circuit portion 226 and CO sensing portion 223. In addition to the functionality described above, alarm 215 may uniquely generate either a smoke or a CO alarm indicator, and respectively use both the interface circuit 118 and filter circuit 124 to communicate a smoke and/or CO alarm condition to other interconnected units.

Additional variations of the foregoing embodiments may be implemented without departing from the spirit and scope of the present invention. For example, a further alternative embodiment of the present invention, shown as 200" in FIG. 2C includes only CO alarms 211 connected by interconnect line 116.

Figure 3:
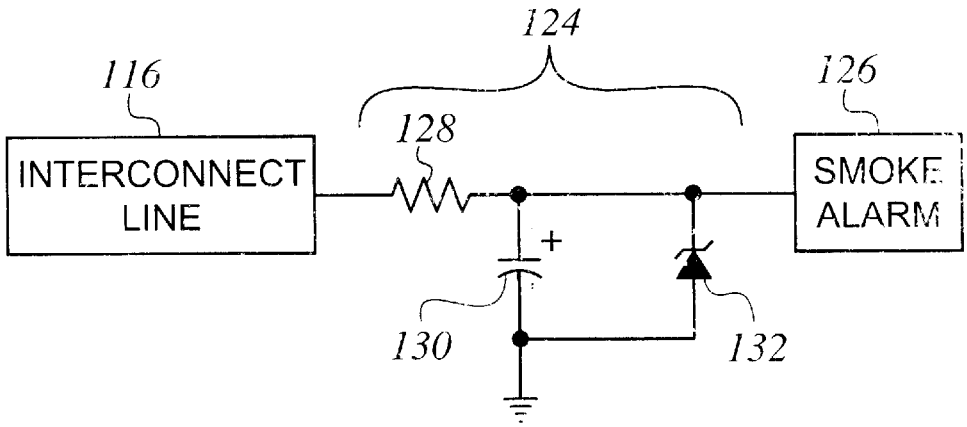
Figure 3 (Prior Art)
FIG. 3 is a schematic representation of a typical smoke alarm interconnect filter.

Referring now to FIG. 3, smoke alarm interconnect filter 124 is discussed in greater detail. Filter 124 is representative of an approach commonly used in self-contained residential smoke alarms that employ an interconnect, and is shown for reference only. Briefly described, the interconnect filter 124 includes a resistor 128 and capacitor 130 that serve as a low-pass filter, i.e., to generally allow only low frequency signals to reach the smoke alarm sensing circuit portion 126 from interconnect line 116 and prevent high frequency transients and 50 or 60 Hz modulation signals (associated with input AC power) from triggering a local alarm indicator. A constant voltage signal present on interconnect line 116 (such as that generated by a typical smoke alarm upon detection of smoke) charges capacitor 130 through resistor 128. When the voltage at capacitor 130 reaches a predetermined threshold value (for example, at least about 3.0 volts at the interconnect port) an alarm indicator is triggered. Zener diode 132 clamps any inappropriate voltage spikes across the capacitor to a sufficiently low level to help prevent damage to alarm circuit portion 126.

Figure 4:
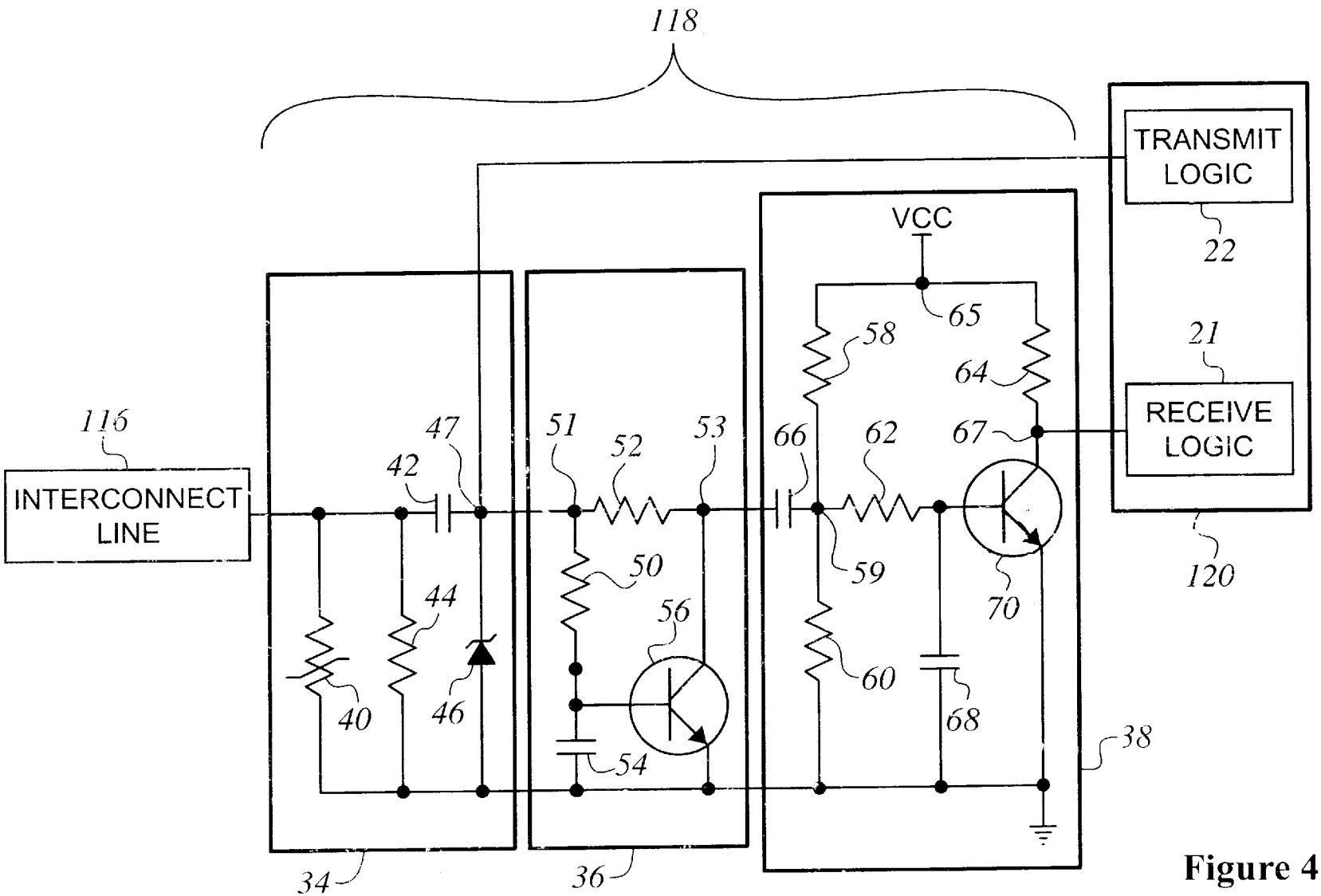
FIG. 4 is a schematic representation of an embodiment of an interface circuit of the present invention.

Turning now to FIG. 4, as described hereinabove, the present invention includes electronic circuitry (interface circuit 118) that enables of a plurality of devices of at least two type hazard alarms to be interconnected without triggering conflicting alarm indicators. Interface circuit 118 transmits and receives digital pulses on interconnect line 116 and modulates the pulses to communicate information to effectively form a digital network. The encoding and decoding of the digital signals may be accomplished directly by electronic circuits or by program code associated with a conventional electronic processor. Interface circuit 118 consumes a minimal amount of power in order to allow battery operation of the alarm and interface circuit.

Interface circuit 118 includes three primary portions: (i) an input protection portion 34, (ii) a high-pass filter portion 36, and (iii) a signal amplifier portion 38. Interface circuit 118 is further connected to logic module 120 to transmit and receive digital information to and from interface line 116, respectively. This functionality of logic module 120 is provided by a receive logic element 21 and a transmit logic element 22, which may each include any type of logic element capable of modulating digital information. As stated hereinabove, logic module 120 may typically be an electronic circuit, a microcontroller, an electronic processor, and/or computer readable program code.

Figure 2C:
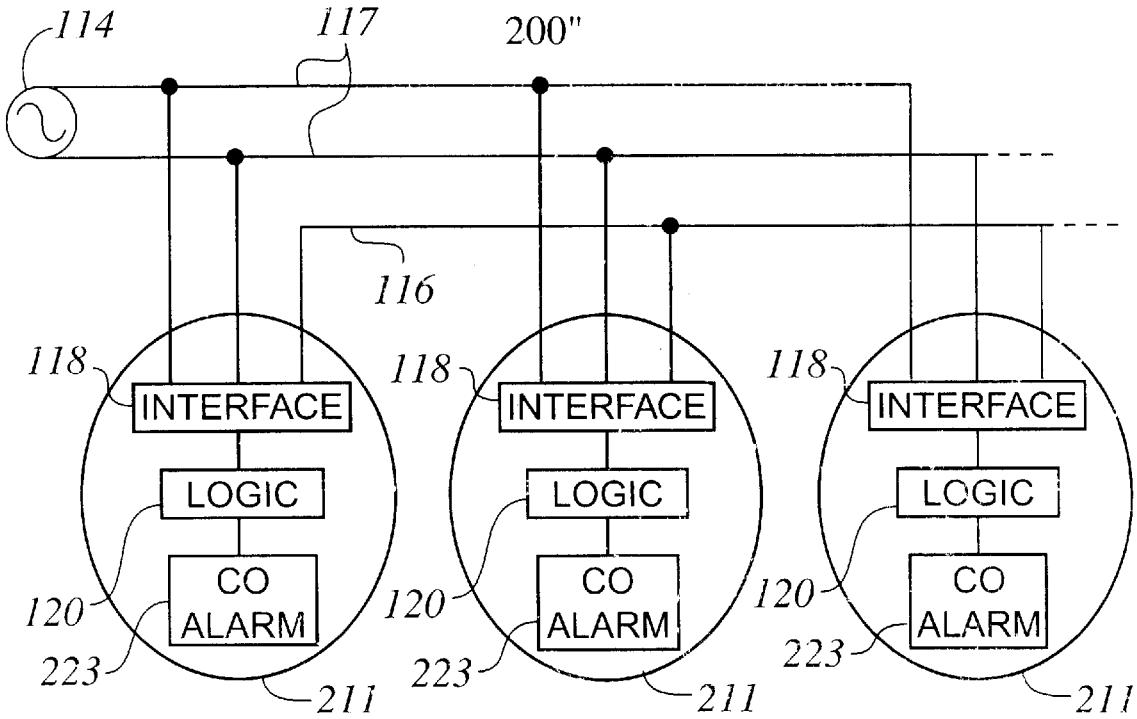

In the embodiment shown, input protection portion 34 includes a metal oxide varistor (MOV) 40 (or an equivalent input protection component such as a zener diode). MOV 40 provides bipolar voltage protection to capacitor 42 at a level predetermined to substantially prevent damage to the capacitor 42. The resistor 44 serves to terminate the interconnect line 116 to help prevent a phenomenon known as ringing on the interconnect line. This may be especially helpful, for example, when only CO alarms are connected to interconnect line 116, such as shown in FIG. 2C discussed hereinabove. Resistor 44 also partially suppresses any voltages induced on interconnect line 116 by AC voltage on adjacent lines. The zener diode 46 clamps the voltage that passes through capacitor 42 to a level that falls within the allowed voltage range for signals of transmit logic element 22. High-pass filter portion 36 includes two resistors 50 and 52, a capacitor 54, and a transistor 56. This circuit holds the voltage at node 53 at the ground potential except when a high frequency signal or pulse appears at node 51. Presence of a low frequency signal at node 51 produces a potential across capacitor 54, which activates transistor 56. Transistor 56 then shorts node 53 to ground. Conversely, presence of a high frequency signal causes the voltage across capacitor 54 to drop to near zero, thereby deactivating transistor 56 and allowing the signal to appear at node 53.

Signal amplifier portion 38 includes a DC bypass capacitor 66, bias resistors 58 and 60, a low-pass filter resistor 62 and capacitor 68, and an amplifying transistor 70 and resistor 64. A power supply (not shown) provides a logic level voltage, VCC (or VDD), at node 65. In the absence of an incoming signal, node 67 is also at VCC (or VDD). Bias resistors 58 and 60 hold the potential at node 59 (i.e., the bias potential) at a level just below the activation voltage of transistor 70. This enables a relatively small signal arriving at node 59 to activate transistor 70. The values of bias resistors 58 and 60 may be large (e.g. greater than 1 mega ohm) in order to minimize power consumption and are chosen to provide a sufficiently high bias potential at node 59. Bypass capacitor 66 allows the potential at node 59 to be maintained while a different DC potential exists at node 53. A low-pass filter including resistor 62, capacitor 68, and transistor 70 function substantially similarly to resistor 50 and capacitor 54, discussed hereinabove, to ground fast transients and undesired high frequency signals, to prevent them from actuating transistor 70. (Alternatively, this low-pass filter may be implemented by omitting capacitor 68 and relying solely on the capacitance inherent in transistor 70.) This low-pass filter, in combination with high-pass filter element 36, creates a band-pass filter designed to pass only the signals of desired frequency while filtering out both higher and lower frequency signals. Thus, although an exemplary embodiment has been shown and described, the skilled artisan should recognize that substantially any combination of conventional low- and high-pass filters, or band-pass filter(s), may be used to provide the aforementioned band-pass functionality, without departing from the spirit and scope of the present invention.

An incoming signal (e.g. a pulse) with a frequency in the band pass range described above, actuates transistor 70, which shorts node 67 to ground (e.g., effectively supplying a logical "0" to logic circuit 120 as discussed in greater detail hereinbelow with respect to receive logic 21). Transistor 70 and resistor 64, effectively function to amplify the relatively small incoming signal appearing at node 59 to a signal of logic level potentials suitable for interface with logic circuit 20, the two logic level potentials being VCC (or VDD) and ground. By general convention, VCC is typically used to refer to transistor logic voltage values (typically up to about 7 volts) while VDD is typically used to refer to CMOS (complimentary MOS) logic voltage values (typically up to about 9 volts).

Figure 6:
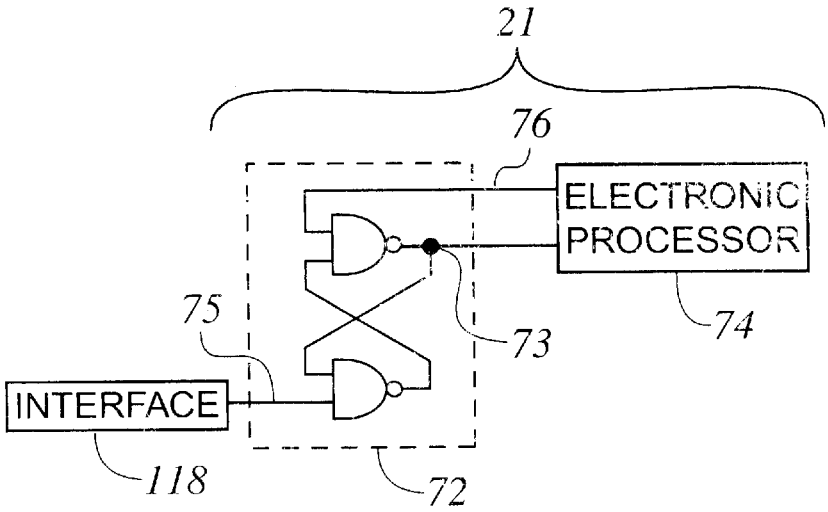
FIG. 6 is a schematic illustration of a NAND gate receive logic diagram used in various embodiments of the present invention.

Referring now to FIG. 6, one embodiment of receive logic element 21 is shown. In this embodiment, receive logic element 21 includes a NAND latch 72 and an electronic processor 74. It is often desirable in some applications for interface circuit 118 and logic module 120 to be relatively energy efficient (for example in applications in which devices 109, 111, and 113 are powered by a battery). Further, when electronic processor 74 is a microcontroller, it may be desirable to put the microcontroller into a low power or 'sleep' mode. In this mode, the microcontroller does not generally process actively and most of its circuitry tends to be inactive. A microcontroller may generally be reactivated by an external signal such as that produced by interface circuit 118. However, with many microcontrollers, the external signal must generally be maintained for some minimum time period in order for the microcontroller to 'wake up' from 'sleep' mode and execute the appropriate logic required to respond to the signal. The signal generated by interface circuit 118 however, is often of short duration. Therefore, it may be desirable to have an external circuit, such as the NAND latch 72, that captures the signal for a duration that is long enough to nominally ensure that the microcontroller 74 is properly 'woken up'. This functionality may be provided in any suitable manner. For example, in the embodiment shown, during 'sleep' mode, the voltages at nodes 73, 75 and 76 are generally (i.e., in the absence of an incoming signal) at a VCC (or VDD) potential, which corresponds to a logical "1". In order to "wake-up" microcontroller 74, a ground pulse (logical "0") may be applied to node 75 by interface circuit 118 (i.e., by node 67 of FIG. 4), which in turn produces a ground potential signal (logical "0") at node 73. The operation of the NAND latch 72 serves to maintain this ground potential at 73 even after the signal from the interface circuit 118 at node 75 has returned to a logical "1", to provide a sufficient "wake-up" signal to the microcontroller 74. When the microcontroller recognizes the ground signal at node 73, it applies a ground potential pulse (logical "0") to the reset line 76 causing the signal at node 73 to return to VCC (or VDD) (logical "1"). Once it is 'awake', the microcontroller 74 may analyze the incoming digital signal (e.g, pulse train) to determined whether or not to actuate an alarm indicator. The skilled artisan will recognize that in light of the foregoing, numerous other means of capturing a short duration signal to provide a microcontroller with sufficient time to process the signal, may be utilized without departing from the spirit and scope of the present invention.

Referring back to FIG. 4, interface circuit 118 may also be utilized to transmit high frequency pulses or signals onto interconnect line 116. This may be accomplished by applying a high frequency signal from transmit logic element 22 of logic module 120 to node 47 of input protection element 34.

Figure 5A:
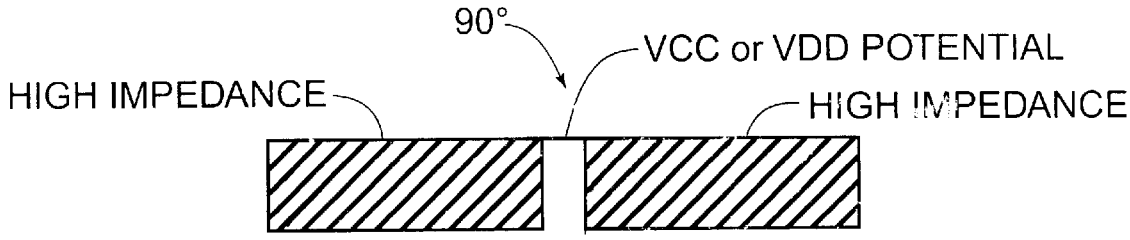
FIG. 5A is a schematic representation of a representative output pulse pattern used by various embodiments of the present invention, wherein each pulse includes a VCC or VDD potential sandwiched by high impedance.
Figure 5B:
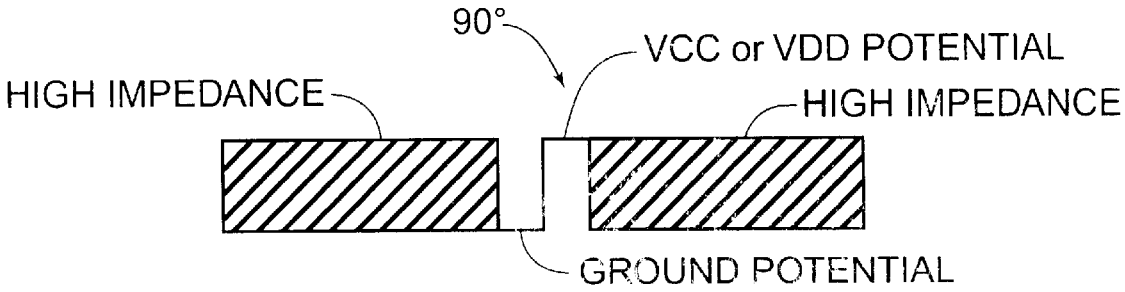
FIG. 5B is a schematic representation of an alternate representative output pulse pattern used by various embodiments of the present invention, wherein each pulse includes a ground potential followed by a VCC or VDD potential sandwiched by high impedance.

The signal transmitted by transmit logic element 22 (and the signal received by receive logic element 21) may be of any type that is effectual for communicating digital information. Two examples of digital signals that may be effective are the voltage pulses shown in FIG. 5. Transmit logic element 22 normally holds its output line in a high impedance state in order to have little or no affect on the signals being received by interface circuit 118. For example, when transmitting a pulse 90 as shown in FIG. 5A, transmit logic element 22 pushes node 47 to VCC (or VDD) potential for a period of time and then returns the output line back to a high impedance state until such time that it is ready to transmit another pulse. When transmitting a pulse 90' as shown in FIG. 5B, transmit logic element 22 first pulls node 47 to ground potential for a predetermined period of time and then pushes node 47 to VCC (or VDD) potential for a similar period of time. Transmit logic element 22 then returns the output line back to a high impedance state. The duration of the pulses (and the associated pulse components) may be of any length of time that provides a signal that is recognizable by receive logic element 21 (i.e., element 21 of another interconnected alarm). For example, logic module 120 and interface circuit 118 may be configured to use a pulse having a duration of less than about 5 milliseconds. In another example, logic module 120 and interface circuit 118 may be configured to use a pulse having a duration from about 2 to about 20 microseconds.

These relatively high frequency signals may be modulated in any fashion in order to communicate information from one device to another. For example, a pulse sequence (e.g., a pulse train) of predetermined frequency may be used to denote an alarm condition or some other condition that may have only two states. Alternatively, the time between pulses may be varied such that a relatively short time is assigned one binary value (e.g., a logical 1) and a relatively longer time is assigned another binary value (e.g., a logical 0). A series of short and long times between pulses may then be used to transmit any manner of information as is common in electronic network communication systems. Further, AMI, Differential NRZ, Manchester encoding, or any other form of pulse code modulation may be used without departing from the spirit and scope of the present invention. Such digital information may be transmitted at a relatively high rate. In one example, logic module 120 and interface circuit 118 may be configured to receive and transmit digital information at a bit rate of greater than about 100 bits per second. In another example, they may be configured to receive and transmit digital information at a bit rate of greater than about 10,000 bits per second. The artisan of ordinary skill will readily recognize that there are numerous means that may be used to modulate the pulses to produce a communication signal according to the present invention.

Depending on the type of information transmitted on interconnect line 116, it may be necessary to determine whether the transmitted information has been corrupted by two or more devices sending signals simultaneously (e.g., generating a collision) or by high frequency noise on interconnect line 116. The interval between pulses, in which transmit logic 22 is emitting a high impedance signal, is used to detect this situation. The present invention may be used to create a peer-to-peer network with collision detection by using techniques well-known to those skilled in the art, such as those commonly used in Ethernet local area networks (LANS). For example, collisions may be indicated when a transmitting device detects extraneous pulses on the interconnect line during transmission of a message. Generally, the transmitting device that has detected the collision may reinforce the collision by sending a series of pulses causing the other transmitting device or devices to also detect a collision. Each of the transmitting devices may then stop transmitting and attempt to retransmit after a random period of time.

The following example illustrates one embodiment of the present invention.

EXAMPLE 1

An alarm system was fabricated according to the principles of the present invention in order to evaluate the performance thereof. The alarm system consisted of thirty-two (32) smoke alarms and two carbon monoxide alarms interconnected together in a three-wire arrangement (similar to that shown in FIG. 1A). The first two lines were used to provide electrical power (nominally 115VAC at 60 Hz) to the alarm devices. The third was used for communicating digital information. The 32 smoke alarms were uniformly distributed along 250 feet of interconnect line, while one carbon monoxide alarm was coupled to each end. Each carbon monoxide alarm included an interconnect circuit substantially identical to that shown in FIG. 4. Circuit values for the interconnect circuit used in this example are given in Table 1. Further, the interface circuit and logic module were configured to transmit logic according to the pulse 90 pattern shown in FIG. 5A at a VDD potential of 9 volts. The interface circuit and logic module were configure to receive logic at a VCC potential of 3.3 volts.

The system of this example was tested repeatedly without failure. An alarm event was triggered numerous times in each of the smoke alarms. In each instance, each of the 32 smoke alarms sounded an alarm while the carbon monoxide alarms remained silent. Further, alarm events were repeatedly triggered in each of the carbon monoxide alarms (once every four seconds for a duration of 4 hours). In each instance, each of the carbon monoxide alarms sounded an alarm while the smoke alarms remained silent. No failures or false alarms were observed in the testing of this example system.

TABLE 1

| Figure Notation | Description | Value or Type |
|---|---|---|
| 40 | Metal Oxide Varistor | 47 V |
| 42 | Capacitor | 0.1 μF |
| 44 | Resistor | 100 kΩ |
| 46 | Zener Diode | 10 V |
| 50 | Resistor | 8.2 kΩ |
| 52 | Resistor | 560 Ω |
| 54 | Capacitor | 0.1 μF |
| 56 | NPN Transistor | 2N3904 |
| 58 | Resistor | 7.5 MΩ |
| 60 | Resistor | 1 MΩ |
| 62 | Resistor | 100 kΩ |
| 64 | Resistor | 1 MΩ |
| 66 | Capacitor | 22 pF |
| 68 | Capacitor | 22 pF |
| 70 | NPN Transistor | 2N3904 |

The foregoing example and description is intended primarily for the purposes of illustration. Although the invention has been described according to an exemplary embodiment, it should be understood by those of ordinary skill in the art that modifications may be made without departing from the spirit of the invention. the scope of the invention is not to be considered limited by the description of the invention set forth in the specification or example, but rather as defined by the following claims.

What is claimed is:

1. A hazard alarm for use in a hazard alarm system, said hazard alarm comprising:

an interface circuit;

a first type sensor coupled to said interface circuit;

a first type alarm indicator coupled to said first type sensor;

a transmitter coupled to said interface circuit to generate a first type signal in response to a first type alarm event detected by the first type sensor, the first type signal being receivable by at least one other hazard alarm connected thereto, to trigger a first type alarm indicator therein, while being free from triggering any second type alarm indicator connected thereto;

a signal receiver operatively coupled to said interface circuit to receive first type signals and second type signals, and to selectively actuate and not actuate said first type alarm indicator upon respective receipt thereof.

2. The alarm of claim 1, further comprising a second type alarm indicator integrally disposed therein, being selectively actuatable and unactuatable upon receipt of the second type signals and first type signals, respectively.

3. The alarm of claim 2, further comprising a second type sensor coupled to said second type alarm indicator.

4. The alarm of claim 1 wherein said alarm indicator is an audible or visible signal.

5. The alarm of claim 1, comprising a first type hazard alarm selected from the group consisting of smoke alarms, heat alarms, carbon monoxide alarms, motion detectors, gas alarms, and building security devices.

6. The alarm of claim 1, comprising a plurality of interconnect ports.

7. The alarm of claim 6 wherein said plurality of interconnect ports comprises first, second, and third interconnect ports, said first and second interconnect ports being configured to receive AC power, and said third interconnect port being coupled to said interface circuit to communicate with the at least one other hazard alarm connected thereto.

8. The alarm of claim 6 wherein said plurality of interconnect ports comprises first and second interconnect ports, said first interconnect port being configured to communicate with the at least one other hazard alarm connected thereto, said second interconnect port being configured as a voltage reference.

9. The alarm of claim 8 comprising a local power source.

10. The alarm of claim 1 wherein said interface circuit is coupled to a logic module for transmitting and receiving digital information.

11. The alarm of claim 10, wherein said logic module is a member of the group consisting of an electronic circuit, a microcontroller, an electronic processor, a programmable logic device, a communications processor, a computer, and computer readable program code.

12. The alarm of claim 1, wherein said interface circuit comprises a filter and an amplifier.

13. The alarm of claim 12, wherein said interface circuit comprises an input protection portion, a high pass filter portion, and a signal amplifier portion.

14. The alarm of claim 13 wherein said input protection portion comprises at least one input protection component selected from the group consisting of a metal oxide varistor and a zener diode.

15. The alarm of claim 14 wherein said input protection component comprises a metal oxide varistor electrically coupled in parallel with a resistor.

16. The alarm of claim 13 wherein said high pass filter portion comprises a transistor.

17. The alarm of claim 16 wherein said transistor is coupled to at least one resistor and at least one capacitor.

18. The alarm of claim 13 wherein said signal amplifier portion comprises a low pass filter coupled to a transistor.

19. The alarm of claim 18 wherein said signal amplifier portion comprises at least two DC bias resistors coupled to a DC bypass capacitor.

20. The alarm of claim 1 wherein said first type signal is communicated in the form of a plurality of electronic pulses.

21. The alarm of claim 20 wherein each of said plurality of electronic pulses has a duration of less than about 5 milliseconds.

22. The alarm of claim 21 wherein each of said plurality of electronic pulses has a duration of from about 2 to about 20 microseconds.

23. The alarm of claim 20 wherein each of said plurality of electronic pulses includes a high pulse, which is preceded and succeeded by high impedance.

24. The alarm of claim 23 wherein said high pulse has a DC voltage of about 9 volts.

25. The alarm of claim 1 wherein said interface circuit transmits and receives digital information at a bit rate of greater than about 100 bits per second.

26. The alarm of claim 25 wherein said interface circuit transmits and receives said digital information at a bit rate of greater than about 10000 bits per second.

27. An alarm system comprising a plurality of first type hazard alarms including said hazard alarms of claim 1, said first type hazard alarms being interconnected to one another.

28. The system of claim 27, comprising:

a plurality of second type hazard alarms having second type alarm indicators therein, said second type hazard alarms being interconnected to said first type hazard alarms;

wherein an alarm event in any one of said plurality of first type hazard alarms triggers a first type alarm indicator in at least one other of said plurality of first type hazard alarms interconnected thereto, while not triggering any of said second type alarm indicators.

29. The system of claim 28 wherein an alarm event in any one of said plurality of second type hazard alarms triggers an alarm indicator in at least one other of said plurality of second type alarm indicators interconnected thereto, while not triggering any of said first type alarm indicators interconnected thereto.

30. The system of claim 28 wherein said first type hazard alarm is a carbon monoxide alarm and said second type hazard alarm is a smoke alarm.

31. The system of claim 28 wherein said second type hazard alarm includes a low pass filter circuit.

32. The system of claim 31 wherein said second type hazard alarm is a member of the group consisting of smoke alarms, heat alarms, carbon monoxide alarms, motion detectors, gas alarms, and building security devices.

33. The system of claim 32 wherein said second type hazard alarm is a smoke alarm.

34. An alarm system comprising:

a plurality of hazard alarms including a plurality of first type hazard alarms and a plurality of second type hazard alarms;

each one of said plurality of hazard alarms including at least one interconnect port;

said first type hazard alarms including an interface circuit coupled to said interconnect port to respectively transmit and receive information with others of said plurality of hazard alarms interconnected thereto;

wherein an alarm event in any one of said plurality of first type hazard alarms triggers an alarm indicator in at least one other of said plurality of first type hazard alarms interconnected thereto, while not triggering an alarm indicator in any of said plurality of second type hazard alarms interconnected thereto;

wherein said interface circuit transmits and receives said information at a bit rate of greater than about 100 bits per second.

35. The system of claim 34 wherein an alarm event in any one of said plurality of second type hazard alarms triggers an alarm indicator in at least one other of said plurality of second type hazard alarms interconnected thereto, while not triggering an alarm indicator in any of said plurality of first type hazard alarms interconnected thereto.

36. The system of claim 34 wherein each of said plurality of hazard alarms includes three interconnect ports, two of which are used to receive AC power, the other of which is used for communicating with said plurality of hazard alarms interconnected thereto.

37. The system of claim 34 wherein each of said plurality of hazard alarms includes two interconnect ports, one of which is used for communicating with said plurality of hazard alarms interconnected thereto, the other of which is utilized as a voltage reference.

38. The system of claim 34 wherein said interface circuit is coupled to a logic module, said logic module being a member of the group consisting of an electronic circuit, a microcontroller, an electronic processor, a programmable logic device, a communications processor, a computer, and computer readable program code.

39. The system of claim 34 wherein said interface circuit comprises a filter and an amplifier.

40. The system of claim 39 wherein said interface circuit comprises an input protection portion, a high pass filter portion, and a signal amplifier portion.

41. The system of claim 34 wherein said first type hazard alarm is a member of the group consisting of smoke alarms, heat alarms, carbon monoxide alarms, motion detectors, natural gas alarms, and propane gas alarms.

42. The system of claim 41 wherein said first type hazard alarm is a carbon monoxide alarm.

43. The system of claim 34 wherein said second type hazard alarm is a smoke alarm.

44. The system of claim 34 wherein said first type hazard alarm is a carbon monoxide alarm and said second type hazard alarm is a smoke alarm.

45. The system of claim 34 wherein said information is communicated in the form of a plurality of electronic pulses.

46. The system of claim 45 wherein each of said plurality of electronic pulses has a duration of less than about 5 milliseconds.

47. The system of claim 45 wherein each of said plurality of electronic pulses includes a high pulse, which is preceded and succeeded by high impedance.

48. The system of claim 47 wherein said high pulse has a DC voltage of about 9 volts.

49. A combination smoke and carbon monoxide alarm system, said system comprising:

a plurality of carbon monoxide alarms;

a plurality of smoke alarms;

each of said plurality of carbon monoxide alarms and each said plurality of smoke alarms including at least one interconnect port;

each of said plurality of carbon monoxide alarms including an interface circuit coupled to said interconnect port to transmit and receive information with other hazard alarms interconnected thereto;

wherein an alarm event in at least one of said smoke alarms does not trigger an alarm indicator in any of said carbon monoxide alarms interconnected thereto and an alarm event in at least one of said carbon monoxide alarms does not trigger an alarm indicator in any of said smoke alarms interconnected thereto.

50. The system of claim 49 wherein each of said plurality of hazard alarms includes three interconnect ports, two of which are used to receive AC power, the other of which is used for communicating with said plurality of hazard alarms interconnected thereto.

51. The system of claim 49 wherein each of said plurality of hazard alarms includes two interconnect ports, one of which is used for communicating with said plurality of hazard alarms interconnected thereto, the other of which is used as a voltage reference.

52. The system of claim 49, comprising a logic module coupled to said interface circuit, said logic module being a member of the group consisting of an electronic circuit, a microcontroller, an electronic processor, a programmable logic device, a communications processor, a computer, and computer readable program code.

53. The system of claim 49 wherein said interface circuit comprises an input protection portion, a high pass filter portion, and a signal amplifier portion.

54. The system of claim 49 wherein said information is communicated in the form of a plurality of electronic pulses.

55. The system of claim 54 wherein each of said plurality of electronic pulses has a duration of less than about 5 milliseconds.

56. The system of claim 54 wherein each of said plurality of electronic pulses includes a high pulse, which is preceded and succeeded by high impedance.

57. The system of claim 56 wherein said high pulse has a DC voltage of about 9 volts.

58. The system of claim 49 wherein said interface circuit transmits and receives digital information at a bit rate of greater than about 100 bits per second.

59. A kit for upgrading a smoke alarm system having a plurality of smoke alarms electrically connected to one another, the kit comprising a plurality of carbon monoxide alarms, each of said carbon monoxide alarms including:

at least one interconnect port;

an interface circuit coupled to said interconnect port to communicate information with other hazard alarms interconnected thereto;

a sensor coupled to the interface circuit to detect an alarm event;

an alarm indicator coupled to the sensor;

a transmitter coupled to said interconnect port to generate a first signal type in response to the alarm event, the first signal type being receivable by at least one other carbon monoxide detector to trigger an alarm indicator therein, while not triggering an alarm indicator in any of the smoke alarms connected thereto;

a signal receiver operatively coupled to said interconnect port to receive signals of the first and a second signal types, and to selectively actuate and not actuate said alarm indicator upon receipt of signals of the first and second types, respectively.

60. A method of fabricating a hazard alarm for use in a hazard alarm system, said method comprising:

providing an interface circuit;

coupling a first type sensor to said interface circuit;

coupling a first type alarm indicator to said first type sensor;

coupling a transmitter to said interface circuit to generate a first type signal in response to a first type alarm event detected by the first type sensor, the first type signal being receivable by at least one other hazard alarm connected thereto, to trigger a first type alarm indicator therein, while being free from triggering any second type alarm indicator connected thereto; and operatively coupling a signal receiver to said interface circuit to receive first type signals and second type signals, and to selectively actuate and not actuate said first type alarm indicator upon respective receipt thereof.

61. A method for upgrading an existing smoke alarm system, having a plurality of smoke alarms electrically connected to one another, said method comprising:

providing a plurality of carbon monoxide alarms, each of said carbon monoxide alarms including an interface circuit coupled to an interconnect port to transmit and receive information with other hazard alarms interconnected thereto;

configuring the carbon monoxide alarms to trigger an alarm indicator in at least one other of said plurality of carbon monoxide alarms in response to an alarm event, while not triggering an alarm indicator in any of the plurality of smoke alarms; and electrically coupling said plurality of carbon monoxide alarms to said smoke alarm system.

* * * * *